United States Patent [19]

Erickson

[11] 3,978,183

[45] Aug. 31, 1976

[54] METHOD OF FILTER MOLDING AND ELECTRICAL HEATING UNIT MADE THEREBY

[75] Inventor: Ronald E. Erickson, Oconomowoc, Wis.

[73] Assignee: Sybron Corporation, Rochester, N.Y.

[22] Filed: June 24, 1974

[21] Appl. No.: 482,011

[52] U.S. Cl. ..... 264/87; 219/544

[51] Int. Cl.[2] ..... B28B 1/26

[58] Field of Search ..... 219/544; 264/87

[56] References Cited

UNITED STATES PATENTS 3,500,444 3/1970 Hessee et al. ..... 219/544

*Primary Examiner*—Donald J. Arnold
*Assistant Examiner*—John Parrish
*Attorney, Agent, or Firm*—Theodore B. Roessel; Roger Aceto

[57] ABSTRACT

A process for producing an electrical heating unit by filter molding an inorganic refractory fiber to form an insulating body about a heating element wherein a layer of insulating fabric is placed on the filter mold screen and the heating element positioned on the fabric prior to filter molding so that the heating element becomes completely embedded in the insulating body and is at a controlled depth below the surface of the insulating body as defined by the thickness of the fabric.

Also disclosed is a sleeve heater having integral vestibules as may be made according to the method of the present invention.

5 Claims, 4 Drawing Figures

METHOD OF FILTER MOLDING AND ELECTRICAL HEATING UNIT MADE THEREBY

BACKGROUND OF THE INVENTION

The present invention relates generally to the filter molding of electrical heating units and more specifically to a filter molding process wherein the heating element is completely embedded in a body of insulating material.

Processes for filter molding an electrical heating unit comprising a heating element and an insulating refractory support are well known in the art. Briefly, such processes as described, for example, in Hesse et al, U.S. Pat. No. 3,500,444 utilize a liquid suspension of any of the well known ceramic refractory fibers. The electrical heating element first is placed against the screen of the filter mold and then a differential pressure created which forces the liquid suspension through the filter screen. The refractory fibers filtered from the suspension are built up on the screen and about the heating element to produce a unit wherein the heating element is completely embedded in the insulating material except for the portion of the heating element direct adjacent the screen.

This portion of the heating element exposed at the surface of the insulating body creates several problems during both the manufacture and use of the unit. For example, during manufacture, it is difficult to position the heating element so that a uniform amount of the heating element is exposed. In use there are many applications where it is not only undesirable, but dangerous to have any portion of the heating element exposed and when manufactured according to the prior art filter molding methods, it is quite possible for the heating element to pull loose during use of the heater. For example, one common alloy for the heating element is a chrome-aluminum-iron alloy. During use, the normal expansion and contraction of the heating element and the grain growth which occurs in such alloys will cause the heating element to pull loose from the supporting ceramic fiber insulation.

The above mentioned Hesse patent teaches that, after filter molding, the exposed surface of the electrical heating element may be protected by overlaying and securing a glass or ceramic cover to the surface of the heating unit. This patent also teaches that an electrical insulation may be supercomposed over the exposed portion of the electrical heating element prior to overlaying the glass or ceramic cover. This method, however, involves extra steps in manufacturing and the difficulty in obtaining the appropriate high temperature bonding agents where mechanical means to attach the cover and electrical insulation are not suitable.

Another proposed solution to this problem is to filter mold a layer of the refractory fiber on the filter mold screen, place the heating element against this layer of fiber and continue the filter molding process to complete the formation of the insulating refractory support. This method too, is not entirely satisfactory in that it is difficult to control the thickness of the layer of refractory fiber initially deposited on the filter mold screen. Further, this initial layer is delicate and easily disturbed when the heating element is placed against it and it is quite possible that the heating element will pierce this initial layer. All of these factors make it difficult to locate the heating element at a uniform depth below the surface of the insulating refractory support, consequently, too much insulating material between the heating element and the surface of the refractory support causes inefficient operation of the heating unit and produces hot spots and subsequent burn out of the heating element. Due to the vacuum forming process, lumping of the fiber in the solution is sometimes difficult to overcome. Therefore, when trying to lay down the initial layer of fiber, prior to inserting the heating element, this lumping will cause an uneven fiber depth. Subsequently, this can cause substantial temperature differentials along the length of the element (hot spots) and poor uniformity over the length of the heating element.

The present invention provides a filter molding method wherein the heating element is completely embedded and fixed in the insulating refractory support at a controlled predetermined depth below the surface of the support.

One example of the type of heater which maybe made by the method of the present invention is a sleeve heater having integral vestibules. Sleeve heaters are typically split cylindrical heaters which are placed about a pipe or line to be heated. Each half or third, etc. of the cylinder heretofore consisted of three parts, a central portion which contained the electrical heating element and sized to accommodate pipes of various diameters and the end portions or vestibules sized to closely fit one pipe diameter. The three portions forming one half of the sleeve heater together with three similar portions forming the other half were assembled in place about the pipe to be heated.

In the sleeve heater of the present invention the entire half or third, etc. of the sleeve heater is filter molded as a unit comprising the central portion with integral end portions or vestibules, the vestibules being easily adapted to accommodate pipes of various diameters within a range acceptable by the central portion.

SUMMARY OF THE INVENTION

The method of the present invention may be characterized in one aspect thereof by the steps of positioning a layer of ceramic fabric on the filter mold screen; placing the heating element against the fabric, and thereafter; filter molding the insulating refractory support about the heating element wherein the ceramic fabric becomes bonded to and forms an integral part of the support which completely encapsulates the heating element.

A heating unit made according to the present method may be characterized as a sleeve heater having a cylindrical central portion with an electrical heating element embedded in the concave surface thereof; and vestibules formed integral the ends of said central portion.

OBJECTS OF THE INVENTION

One object of the present invention is to provide a method for producing an electrical heating unit wherein the electrical heating element is completely encapsulated in a filter molded insulating refractory support.

Another object of the present invention is to provide a method for producing a electrical heating unit with an insulated refractory support wherein the electrical heating element is positioned at a controlled depth below the surface of the support.

A further object of the present invention is to provide a filter molding process for manufacturing an electrical heating unit wherein the heating unit is firmly fixed in a mass of insulating material at a controlled depth below the surface of the material.

Yet another object of the present invention is to provide a filter molded sleeve heater having integral vestibules wherein the electrical heating element of the heater is embedded therein at a predetermined depth below the concave surface of the sleeve heater.

These and other objects, advantages and characterizing features of the present invention will become more apparent upon consideration of the following detailed description thereof when taken in connection with the accompanying drawings depicting the same.

DESCRIPTION OF THE PREFERRED EMBODIMENTS

Figure 1:
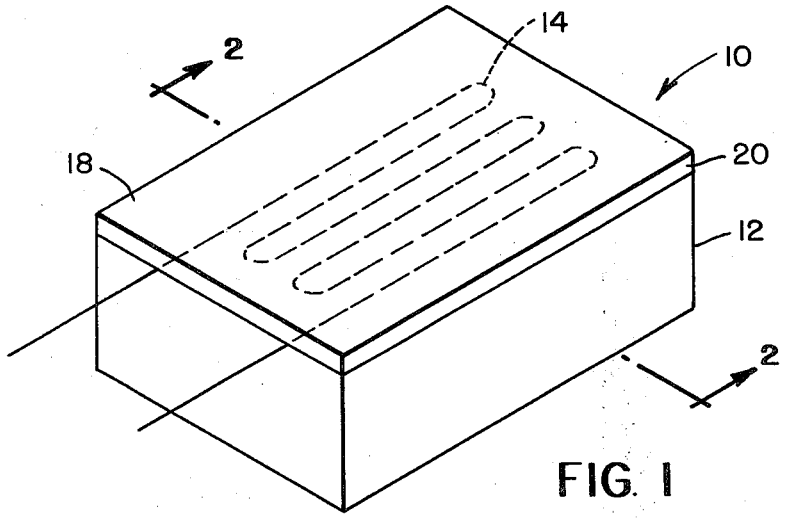
FIG. 1 is a top perspective view illustrating an electrical heating unit made in accordance with the method of the present invention.

Referring to the drawings, FIG. 1 shows an electrical heating unit generally indicated at 10 made in accordance with the method of the present invention. The unit simply comprises a insulating support 12 and a heating element 14 embedded in the support. The heating element may be any suitable wire or ribbon heater but preferably is a coil resistance heating element. Support 12 consists of a body of inorganic refractory fiber insulation material formed by filter molding the fiber in situ about the heating element 14 from a liquid suspension of the fiber.

Figure 2:
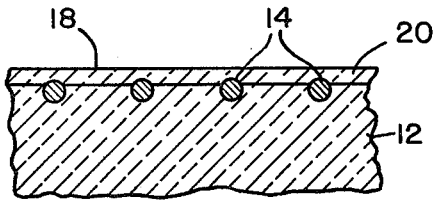
FIG. 2 is a cross-sectional view on an enlarged scale taken along lines 2—2 of FIG. 1.

As shown in FIG. 2, heating element 14 is embedded wholly within the insulating body with all portions of the heating element being disposed at a substantially constant uniform depth below the top surface 18 of the insulating body. This top surface 18 is formed by a sheet of ceramic fiber material 20 which also defines the top layer of insulating body 12. Although the heating element presses slightly into the sheet of ceramic material, the thickness of the ceramic material functions as a spacer to accurately position the heating element at the proper depth below the surface. This sheet of material 20 becomes an integral part of body 12 during the manufacturing process as set out herein below. As shown in FIG. 2, it is the thickness of this sheet 20 which defines the depth at which heating element 14 is located.

In manufacturing heating element 10, a sheet of ceramic fiber material is located against the filter mold screen. Sheet 20 can be any of the conventional ceramic fiber, binder free papers. Such papers having a nominal uncompressed thickness varing from 1/32 to ¼ inch are commonly used as high temperature gaskets but the preferred thickness for purposes of the present invention is about 1/32 to ⅛ inch. When ceramic papers greater than ⅛ inch in thickness are used, the heating properties of the unit tend to decrease as the ceramic paper is itself an insulator. If a thickness less than 1/32 inch is used, the danger of the heating element breaking through the sheet is increased. It is also essential that the ceramic paper itself be binder free or at least free of any organic binder. Organic binders tend to smoke and burn at temperatures between 500° and 600°F. This starves the chrome-aluminum-iron base alloy heating element of oxygen causing a relatively rapid deterioration and failure of the heating element. If no organic binder is present to burn, a protective aluminum oxide coating forms on the heating element during its operation.

In any event, the ceramic paper contemplated for use herein is of a type which resists oxidation and reduction and if wet by water have their thermal and physical properties completely restored upon drying. The chemical analysis of the ceramic fiber paper as manufactured, for example, by The Carborundum Company under the trademark "Fiberfrax" includes:

| | |
|---|---|
| $Al_2O_3$ | 51.7% |
| $SiO_2$ | 47.6% |
| $Na_2O$ | 0.3% |
| $B_2O_3$ | 0.15% |
| $Fe_2O_3$ | 0.02% |
| Trace Inorganic | 0.2% |

The paper has a melting point of approximately 3,000°F, a density of 10 to 12 pounds per cubic foot and specific gravity of 2.53 grams per $cm^3$.

After this sheet of ceramic fiber paper is placed against the filter mold screen, the electric heating element is positioned directly on and in contact with the ceramic paper.

The filter molding slurry from which the main portion of insulating support 12 is made comprises a refractory fiber and colloidal silica dispersed within a liquid medium in proportions to provide a relatively dilute suspension. Particular inorganic refractory fiber materials, the preferred solution, and densities of the molded insulating support are all discussed in detail in the aforementioned Hesse, et al patent. It is important for purposes of the present invention, however, that the binder dispersed in the slurry be an inorganic binder, preferably silica. Organic binders in the slurry will tend to contaminate the ceramic paper to produce the undesirable results set out above. Silica is preferred in that it will not burn or smoke at the operating temperature of the heating unit and will act to "case harden" the unit as set out further hereinbelow.

A differential pressure is then created across the filter screen so that the liquid phase of the suspension passes through the ceramic paper and screen wherein the ceramic paper filters the refractory fiber from the liquid suspension. The refractory fibers are themselves on the order of 2–3 microns in diameter so during the filter molding process portions of the fibers penetrate to the ceramic paper. The filter molding process continues until the insulating body 12 of the desired thickness has been accumulated on the ceramic paper and formed about the heating element.

The body of insulating material 12 together with the layer of ceramic paper 20 and the encapsulated heating element 14 are then removed from the filter screen and allowed to dry. Drying can be accomplished either in air or at an accelerated rate in an oven. Oven drying is preferred as it enhances the migration of colloidal silica. In any event, during the drying process, the colloidal silica binder tends to migrate towards the surface of insulating body 12. This migration is more particularly described in an Aug. 19, 1971 publication of the E. I.

Dupont DeNemours and Company, Inc. by I. E. Willis entitled, *Bonding Inorganic Fiber Process with "Ludox" Colloidal Silica and Positive SOL 130M.* This publication indicates that upon drying there is movement or migration of the silica particles to the outer surfaces of the shape. This results in a case harden exterior and a soft, weak interior. For purposes of the method of the present invention, this migration of the silica particles to the ceramic paper, and insulating body 12 interface, helps to bond the paper to the insulating body. The bonding effect of the colloidal silica together with the penetration of the refractory fibers into the ceramic paper produces an integral insulating body structure.

An an optional, but preferred, last step in the method of manufacturing an electrical heating unit described herein, the upper surface 18 of the unit is coated with a flowable binder having a consistancy of Latex paint and which consists of a mixture of colloidal silica and zirconium oxide. Even with embedding the heating element under a layer of ceramic fiber paper as described herein, it has been found that while the separation of the heating element from the insulation is retarded, it still occurs eventually. However, application of the zirconium oxide-colloidal silica coating has been found to stop such separation. The coating provides a hard, durable surface which prevents the heating element from growing through it, and in fact, makes the element grow back into the body of the fibrous insulation.

The above mentioned Dupont publication also describes the coating material. The preferred formulation for purposes of the present invention comprises approximately 75% ZiO having a grain size of 325 mesh and 25% silica having a grain size of 100 mesh. These materials are mixed with colloidal silica to form a mixture which can be either painted or sprayed on to surface 18. Such a coating will harden the surface and give it improved abrasion resistance and heat reflection properties.

Figure 3:
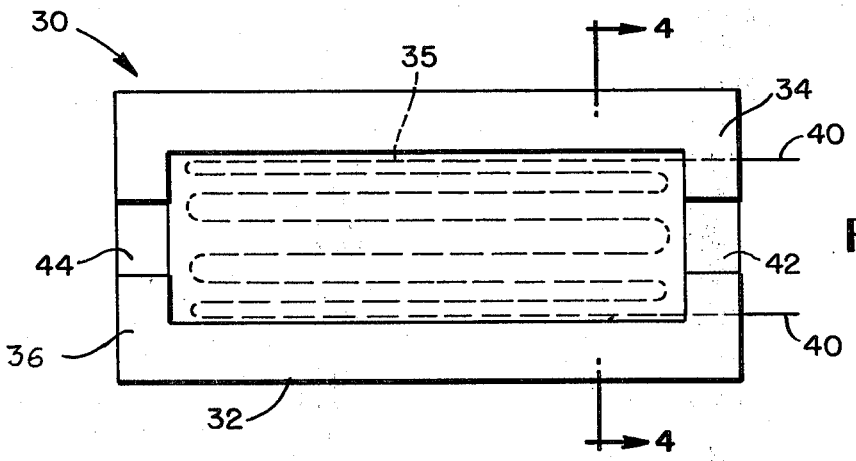
FIG. 3 is a plan view of a sleeve heater made in accordance with the method of the present invention.
Figure 4:
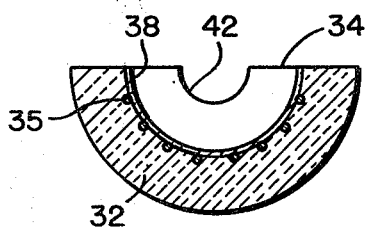
FIG. 4 is a section view taken along lines 4—4 of FIG. 3.

Aside from the relatively flat heating units as shown in FIGS. 1 and 2, the method of the present invention may also be used to filter mold heating units of other shapes. For example, FIGS. 3 and 4 show a generally semi-cylindrical heating unit which may be used as a sleeve heater. In this respect, the heating unit, generally indicated at 30, includes a semi-cylindrical body portion 32 having integrally formed vestibules 34 and 36 defining the end walls of the unit. The heating element 35 extends along the internal concave surface of the unit. It is only over this portion of the unit that a spacer of ceramic paper 38 (FIG. 4) is placed, the paper defining the concave surface of the unit. The leads from the heating coil are indicated at 40. Each vestibule 34, 36 is filter molded with axially aligned semi-circular nests 42, 44 for accommodating the pipe to be heated.

In use then, a pair of the semi-circular heating sleeves 30 are placed about the pipe to be heated to enclose the pipe, wherein the passage of the pipe through the heater being accommodated by the openings formed by the nests 42 and 44. Since the nests 42, 44 are free of the ceramic paper, the nests can be easily adapted by cutting or shaving with a sharp tool to accommodate pipes of various sizes. With this arrangement, then one sleeve size as defined by the radius of the internal concave surface can be used about a wide range of pipe sizes by simply shaving nests 42, 44 as required to fit about the diameter of the pipe.

Thus, it should be appreciated that the present invention accomplishes its intended objects in providing a method for filter molding an electrical heater unit wherein the electrical heating element is completely embedded in the insulating body of the unit at a predetermined depth below the surface of the unit.

Having described the invention in detail, what is claimed as new is:

1. A method of filter molding an electrical heating unit having an electrical heating element embedded wholly within and at a controlled depth from the surface of an insulating body comprising the steps of:

a. dispersing an inorganic refractory fiber and a colloidal silica binder in a liquid to form dilute suspension;

b. positioning a sheet of ceramic fiber paper upon and in contact with a filter mold screen, the thickness of said sheet corresponding to the depth below the surface of said body said heating element is to be located;

c. positioning said electrical heating element on said sheet;

d. creating a pressure differential across said filter mold screen to drain said liquid suspension through said sheet and screen, said refractory fiber being filtered from said liquid suspension and deposited on said sheet and about said heating element;

e. continuing step (d) to accumulate a layer of said refractory fiber on said sheet and about said heating element of sufficient depth to completely embedded said heating element therein;

f. removing said sheet, heating element and layer of refractory fiber as a unit from said filter mold screen; and g. drying said unit during which period the colloidal silica in said layer migrates to the interface between said sheet and layer of refractory fiber and bonds said sheet to said layer.

2. A method as in claim 1 including the step of applying a slurry of colloidal silica and zirconium oxide to the exposed surface of said sheet after filter molding of said layer, the zirconium oxide having a particle size of about 100 mesh.

3. A method as in claim 1 wherein said filter mold screen has a semi-cylindrical portion and said sheet of ceramic paper is applied to the convex surface of said screen.

4. A method as in claim 1 wherein said sheet of ceramic paper has a thickness of between 1/32 and ¼ inch.

5. In a method for filter molding an electric heating unit from a solution of an inorganic refractory fiber and a collodial silica binder wherein a differential pressure is created across a filter mold screen to filter the inorganic refractory fiber from the solution and deposit the fiber on and about an electric heating element positioned on the upstream side of the filter mold screen to form the insulating body of the unit, the improvement comprising the method of locating the heating element at a controlled depth from the surface of the electric heating unit by the steps of:

a. positioning a sheet of ceramic fiber paper upon and in contact with the upstream side of the filter mold screen, said sheet defining a surface of the heating unit to be formed and the thickness of said sheet corresponding to the depth below the surface of said heating unit said heating element is to be located;

b. positioning said electric heating element against the upstream side of said sheet; and c. creating said differential pressure to deposit said inorganic refractory fiber against said sheet and over said electric heating element to form the insulating body of the heating unit.

* * * * *